US012599958B2

(12) United States Patent
Shiratori et al.

(10) Patent No.: US 12,599,958 B2
(45) Date of Patent: Apr. 14, 2026

(54) COMPOSITE MATERIAL, MANUFACTURING METHOD FOR COMPOSITE MATERIAL, AND MOLD

(71) Applicant: PROTERIAL, LTD., Tokyo (JP)

(72) Inventors: Hiroshi Shiratori, Tokyo (JP); Shuho Koseki, Tokyo (JP); Shinsuke Ando, Tokyo (JP); Kousuke Kuwabara, Tokyo (JP); Shinya Okamoto, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 0 days.

(21) Appl. No.: 18/688,320

(22) PCT Filed: Nov. 22, 2022

(86) PCT No.: PCT/JP2022/043229
§ 371 (c)(1),
(2) Date: Feb. 29, 2024

(87) PCT Pub. No.: WO2023/095805
PCT Pub. Date: Jun. 1, 2023

(65) Prior Publication Data

US 2024/0390973 A1 Nov. 28, 2024

(30) Foreign Application Priority Data

Nov. 26, 2021 (JP) ..... 2021-191761

(51) Int. Cl.
*B22F 7/00* (2006.01)
*B22D 15/00* (2006.01)

(52) U.S. Cl.
CPC ..... *B22D 15/00* (2013.01); *B22F 7/00* (2013.01)

(58) Field of Classification Search
CPC ..... B22F 7/00
(Continued)

(56) References Cited

U.S. PATENT DOCUMENTS 4,950,327 A 8/1990 Eck et al.
2015/0040639 A1 2/2015 Sasaki et al.
(Continued)

FOREIGN PATENT DOCUMENTS

JP 50-020936 A 3/1975
JP 62-103355 A 5/1987
(Continued)

OTHER PUBLICATIONS

International Search Report and Written Opinion issued in corresponding International Application No. PCT/JP2022/043229, dated Feb. 7, 2023, 11 pages.
(Continued)

*Primary Examiner* — Katherine A Christy
(74) *Attorney, Agent, or Firm* — Rothwell, Figg, Ernst & Manbeck, P.C.

(57) ABSTRACT

A composite material that is durable in a hot environment and easily produced. The composite material has an overlaid part comprising high-melting-point metal in at least a part on the surface of a low-melting-point alloy member having a melting point of 1600° C. or lower. The overlaid part comprising high-melting-point metal comprises high-melting-point metal particles comprising high-melting-point metal elements having a melting point of 2400° C. or higher scattered therein and comprises the high-melting-point metal elements that account for 50% by mass to 95% by mass thereof.

7 Claims, 15 Drawing Sheets

(58) Field of Classification Search
USPC ..... 428/548
See application file for complete search history.

(56) References Cited

U.S. PATENT DOCUMENTS

| | | | |
|---|---|---|---|
| 2016/0223041 | A1 | 8/2016 | Saga et al. |
| 2016/0296997 | A1 | 10/2016 | Kwang et al. |
| 2018/0104740 | A1 | 4/2018 | Yamamoto et al. |

FOREIGN PATENT DOCUMENTS

| | | | |
|---|---|---|---|
| JP | 63-144869 | A | 6/1988 |
| JP | 63-281797 | A | 11/1988 |
| JP | H01-502680 | A | 9/1989 |
| JP | H05-331694 | A | 12/1993 |
| JP | 2001-314971 | A | 11/2001 |
| JP | 2002178156 | A | 6/2002 |
| JP | 2010-042419 | A | 2/2010 |
| JP | 2012-233530 | A | 11/2012 |
| JP | 2014-208363 | A | 11/2014 |
| JP | 2015055351 | A | 3/2015 |
| JP | 2015-128794 | A | 7/2015 |
| JP | 2016-68121 | A | 5/2016 |
| JP | 2016-159335 | A | 9/2016 |
| JP | 2001-96336 | A | 4/2021 |
| WO | 2016158687 | A1 | 10/2016 |
| WO | 2017154309 | A1 | 9/2017 |

OTHER PUBLICATIONS

Extended European Search Report dated Dec. 1, 2025 issued in European Application No. 22898588.3. (10 pages).

COMPOSITE MATERIAL, MANUFACTURING METHOD FOR COMPOSITE MATERIAL, AND MOLD

CROSS-REFERENCE TO RELATED APPLICATION(S)

This application is a 35 U.S.C. § 371 National Phase Entry Application from PCT/JP2022/043229, filed on Nov. 22, 2022, which claims the benefit of JP 2021-191761, filed on Nov. 26, 2021, the disclosures of which are herein incorporated by reference in their entirety.

TECHNICAL FIELD

The present invention relates to a composite material preferably used for a mold, such as a casting mold used to cast an aluminum alloy, a method for producing a composite material, and a mold using such composite material. BACKGROUND For a structure used in a hot environment, for example, a metal material having heat resistance, such as JIS (Japanese Industrial Standards) SKD61, is used. When structures such as low-pressure casting, gravity casting, die casting, and other molds for aluminum alloys are used in a hot environment, damage or deformation may occur. As causes of damage when using a mold, for example, dissolution loss and galling are known. When a structure suffers from damage or deformation, a damaged or deformed site is repaired by overlaying a repairing material thereon. In such a case, a repairing material is preferably an alloy with heat resistant properties, such as a high melting point and dissolution loss resistance.

Patent Literature 1: JP Patent Publication (Kohyo) No. H01-502680 A

BRIEF SUMMARY

Technical Problem

The alloy disclosed in Patent Literature 1 has a high melting point and excellent creep strength; that is, it has heat resistance. However, a high-melting-point metal, such as the alloy disclosed in Patent Literature 1, has difficulty in producing a structure, such as a mold, by casting because of its high melting point. When producing a structure using such a high-melting-point metal, accordingly, production is often performed by sintering as disclosed in Patent Literature 1. While sintering facilitates production of the entire structure with the use of a single type of a metal, sintering is not suitable for production of a structure with the use of different types of metals in combination for the following reasons. That is, thermal stress cracking may occur because of differences in thermal expansion coefficients among different types of metals. When producing a structure using a high-melting-point metal, accordingly, it is preferable to produce the entire structure with the use of a single type of a metal by sintering. However, the structure consisting of a high-melting-point metal is not practical in terms of a production cost and usability because the material is very expensive and has a very high specific gravity.

Under the above circumstances, the objects of the present invention are to provide a composite material that is durable when used in a hot environment and contributes to cost reduction, a method for easily producing such composite material, and a mold using such composite material.

Technical Solution

The composite material according to the present invention comprises an overlaid part (an padding part) comprising high-melting-point metal in at least a part on the surface of a low-melting-point alloy member having a melting point of 1600° C. or lower, wherein the overlaid part comprising high-melting-point metal comprises high-melting-point metal particles comprising high-melting-point metal elements having a melting point of 2400° C. or higher scattered therein and comprises the high-melting-point metal elements in a range of 50% by mass to 95% by mass.

In addition, the mold according to the present invention is a mold using the composite material described above.

The method for producing the composite material according to the present invention comprises a step of forming an overlaid part comprising high-melting-point metal in which high-melting-point metal particles comprising high-melting-point metal elements with a melting point of 2400° C. or higher are scattered by feeding starting powders comprising the high-melting-point metal powders having a melting point of 2400° C. or higher to the surface of the low-melting-point alloy member while applying a thermal energy to the surface of a low-melting-point alloy member having a melting point of 1600° C. or lower to melt the low-melting-point alloy member.

The present description includes part or all of the contents as disclosed in the description and/or drawings of Japanese Patent Application No. 2021-191761, which is a priority document of the present application.

Advantageous Effects of Invention

The composite material according to the present invention comprises, in a part thereof, an overlaid part comprising high-melting-point metal in which particles comprising high-melting-point metal elements are scattered. Thus, the composite material can exert durability when used in a hot environment and it can contribute to cost reduction. With the use of such composite material, in addition, a mold that is easily produced and suitable for use in a hot environment can be provided.

DETAILED DESCRIPTION

Figure 1A:
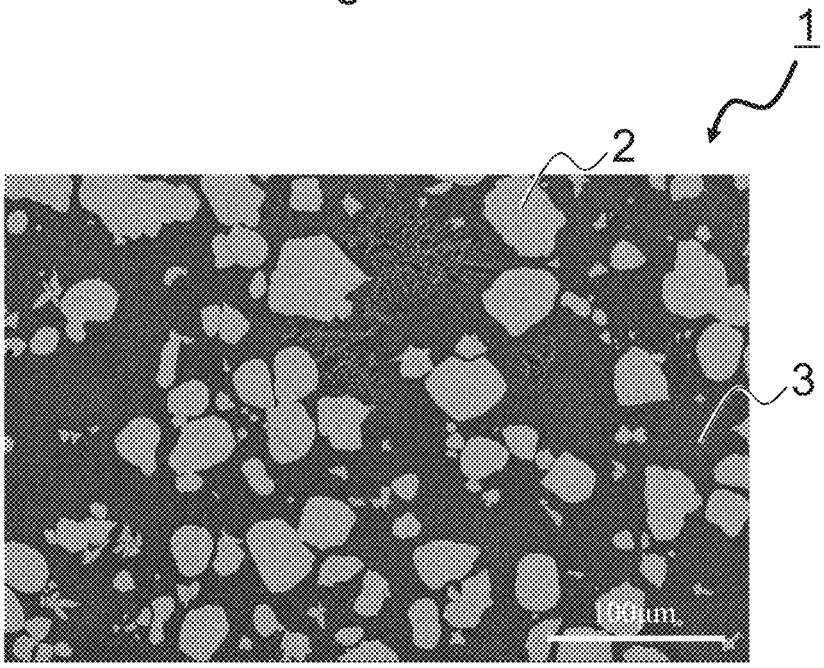
FIG. 1A shows a backscattered electron image (BEI) of the overlaid part comprising high-melting-point metal of Sample No. 1 of Example 1 observed at 300× magnification.

Hereafter, embodiments of the composite material, the method for producing the composite material, and the mold according to the present invention are described with reference to the figures and the like. The description provided below demonstrates specific examples of the disclosure of the present invention, and the present invention is not limited to these examples. A person skilled in the art can make various modification and improvement on the present invention within the technical scope disclosed herein. In all the figures illustrating the present invention, members having the identical function are indicated by the identical reference signs, and the repeated description thereof may be omitted.

The preposition "to" is used herein to include numerical values before and after the preposition as the lower limit and the upper limit. In numerical ranges demonstrated in phases herein, the upper or lower limit within a numerical range may be substituted with another upper or lower limit demonstrated in phases. The upper or lower limit within a numerical range provided herein may be substituted with a value provided in the examples.

When a material is selected from among materials exemplified below, a single material may be selected or a plurality of materials may be selected in combination within a scope consistent with the present disclosure. Alternatively, materials other than the materials exemplified below may be selected within a scope consistent with the present disclosure.

[Composite material] A composite material according to an embodiment comprises an overlaid part comprising high-melting-point metal in at least a part on the surface of a low-melting-point alloy member having a melting point of 1600° C. or lower, wherein the overlaid part comprising high-melting-point metal comprises high-melting-point metal particles comprising high-melting-point metal elements having a melting point of 2400° C. or higher scattered therein and comprises high-melting-point metal elements having a melting point of 2400° C. or higher in a range of 50% by mass to 95% by mass. The "overlaid part comprising high-melting-point metal" comprises high-melting-point metal particles comprising high-melting-point metal elements that account for, for example, 90% by mass or more thereof scattered therein. This does not indicate that the melting point of the overlaid part comprising high-melting-point metal is high.

In a composite material according to an embodiment, a low-melting-point alloy member is equivalent to, for example, a mold substrate. The composite material has, for example, an overlaid part comprising high-melting-point metal in which a large quantity of high-melting-point metal elements are comprised in high-melting-point metal particles in at least a part on the surface of the mold substrate. Accordingly, it is not necessary to produce the entire structure of a structure, such as a mold, with the use of a high-melting-point metal, and it is possible to selectively form a site where damage or deformation is likely to occur with the use of high-melting-point metals. This enables the use of a high-melting-point metal that is difficult to be applied to a structure such as a mold as a material constituting a part of the structure. Thus, a structure having a high melting point and excellent heat resistance can be produced, and damage or deformation of a structure occurring in a hot environment can be suppressed.

[Low-melting-point alloy member] A low-melting-point alloy member is not particularly limited, provided that it comprises an alloy having a melting point of 1600° C. or lower (hereafter, it may be abbreviated as a "low-melting-point alloy"). A member comprising a low-melting-point alloy with a melting point that is equivalent to or higher than the preheating temperature described below (300° C. to 700° C.) is preferable. A preferable example of a low-melting-point alloy member is a member comprising at least one type of a low-melting-point alloy selected from among a Fe-based alloy, a Ni-based alloy, a Co-based alloy, a Ti-based alloy, a Cr-based alloy, and a high-entropy alloy. Such low-melting-point alloys are easily produced as alloys having a melting point of 1600° C. or lower. With the application of the thermal energy, such as the arc, laser, or electron beam energy, accordingly, a low-melting-point alloy member that can easily form a molten pool can be easily prepared. A member comprising a Fe-based alloy is particularly preferable as a low-melting-point alloy member.

A Fe-based alloy is not particularly limited, provided that it comprises Fe. For example, a Fe-based alloy comprises 50% by mass or more Fe and at least one element selected from among nickel (Ni), chromium (Cr), cobalt (Co), molybdenum (Mo), tungsten (W), niobium (Nb), aluminum (Al), titanium (Ti), zirconium (Zr), tantalum (Ta), vanadium (V), hafnium (Hf), manganese (Mn), silicon (Si), lanthanum (La), magnesium (Mg), carbon (C), and boron (B). When a low-melting-point alloy member consists of a Fe-based alloy, for example, the low-melting-point alloy member comprises 50% by mass or more Fe, 18.0% by mass to 19.0% by mass Ni, 8.5% by mass to 9.5% by mass Co, 4.7% by mass to 5.2% by mass Mo, 0.05% by mass to 0.15% by mass Al, 0.5% by mass to 0.7% by mass Ti, 0.1% by mass or less Mn, 0.1% by mass or less Si, 0.01% by mass or less P and S, and 0.03% by mass or less C.

A Ni-based alloy is not particularly limited, provided that it comprises Ni. For example, a Ni-based alloy comprises 50% by mass or more Ni and at least one element selected from among chromium (Cr), cobalt (Co), molybdenum (Mo), tungsten (W), niobium (Nb), aluminum (Al), titanium (Ti), iron (Fe), zirconium (Zr), tantalum (Ta), vanadium (V), hafnium (Hf), manganese (Mn), silicon (Si), lanthanum (La), magnesium (Mg), carbon (C), and boron (B). When a low-melting-point alloy member consists of a Ni-based alloy, for example, the low-melting-point alloy member comprises 50% by mass or more Ni, 8% by mass to 22% by mass Cr, 28.5% by mass or less Co, 14.5% by mass or less Mo, 12% by mass or less W, 5% by mass or less Nb, 6.1% by mass or less Al, 4.7% by mass or less Ti, 18.5% by mass or less Fe, 0.1% by mass or less Zr, 4% by mass or less Ta, 1.0% by mass or less V, 1.3% by mass or less Hf, 0.05% by mass to 0.7% by mass Mn, 0.5% by mass or less Si, 0.02% by mass or less La, 0.02% by mass or less Mg, 0.02% by mass to 0.2% by mass C, and 0.05% by mass or less B.

A Co-based alloy is not particularly limited, provided that it comprises Co. For example, a Co-based alloy comprises 50% by mass or more Co and at least one element selected from among Cr, Ni, W, Mo, V, Fe, Mn, Si, and C. When a low-melting-point alloy member consists of a Co-based alloy, for example, the low-melting-point alloy member comprises 50% by mass or more Co, 30% by mass or less Cr, 22% by mass or less Ni, 15% by mass or less W, 4.25% by mass or less Mo, 1.7% by mass or less V, 50% by mass or less Fe, 2.0% by mass or less Mn, 1.0% by mass or less Si, and 1.1% by mass or less C.

A Ti-based alloy is not particularly limited, provided that it comprises Ti. For example, a Ti-based alloy comprises 50% by mass or more Ti and at least one element selected from among Fe, Cr, W, Mo, Nb, Al, Zr, Ta, V, Y, Sn, Cu, Mn, Si, C, N, O, and H. When a low-melting-point alloy member consists of a Ti-based alloy, for example, the low-melting-point alloy member comprises 50% by mass or more Ti, 5.50% by mass to 6.75% by mass Al, 3.5% by mass to 4.5% by mass V, 0.3% by mass or less Fe, 0.08% by mass or less C, 0.2% by mass or less O, 0.05% by mass or less N, and 0.015% by mass or less H.

A method for producing a low-melting-point alloy member (e.g., a member of a mold) is not particularly limited, and examples of methods include a casting method and an additive manufacturing method.

[Overlaid part comprising high-melting-point metal] In a composite material according to an embodiment, the overlaid part comprising high-melting-point metal comprises high-melting-point metal particles comprising high-melting-point metal elements having a melting point of 2400° C. or higher scattered therein, and the high-melting-point metal particles comprise, for example, 90% by mass or more high-melting-point metal elements having a melting point of 2400° C. or higher. Also, the overlaid part comprising high-melting-point metal is composed of the high-melting-point metal elements that account for 50% by mass to 95% by mass thereof. The overlaid part comprising high-melting-point metal comprises the high-melting-point metal elements that account for 50% by mass to 95% by mass thereof. This improves dissolution loss resistance and other performance. When the content of the high-melting-point metal elements is less than 50% by mass, sufficient effects cannot be attained.

The composite material preferably has a depth of overlaying (the overlaid part) from the surface of the overlaid part (the padding part) comprising high-melting-point metal of 300 μm or more, and more preferably 500 μm or more. The depth of overlaying (the depth of the overlaid part) from the surface of the overlaid part comprising high-melting-point metal is the depth of the overlaid part comprising high-melting-point metal from the surface of the overlaid part comprising high-melting-point metal. Al dissolution loss may advance locally depending on the conditions of usage. When the local dissolution loss reaches the substrate component, dissolution loss rapidly advances therefrom. When the depth of overlaying is less than the lower limit, dissolution loss may rapidly occur. The composite material preferably has the Rockwell hardness of 40 HRC or higher in the overlaid part comprising high-melting-point metal. Such material is preferable because remarkable effects of suppressing deformation at high temperature are attained.

Figure 1B:
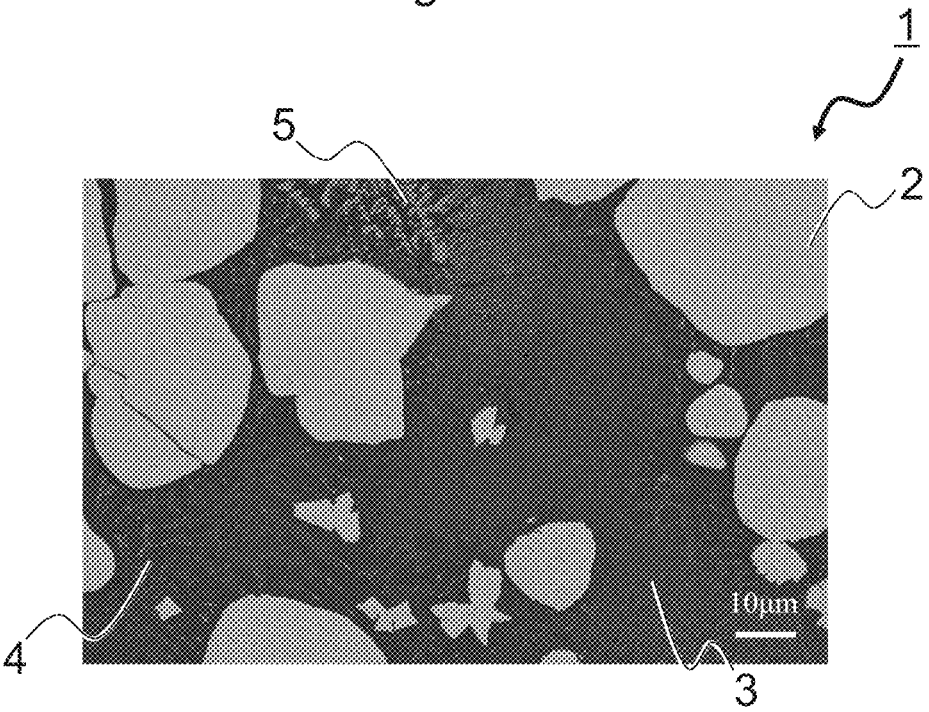
FIG. 1B shows a backscattered electron image of the overlaid part comprising high-melting-point metal of Sample No. 1 of Example 1 observed at 1000× magnification.

[Structure of overlaid part comprising high-melting-point metal] FIG. 1A and FIG. 1B each show an image of a melt-solidified structure of a low-melting-point alloy in an overlaid part comprising high-melting-point metal of a composite material according to an embodiment. The image shown in FIG. 1A is a backscattered electron image (BEI) of a cross section obtained by cutting the composite material on a plane perpendicular to the travel direction of the bead (an overlaid part comprising high-melting-point metal) to obtain a cross section and mirror-polishing the cross section observed under a scanning electron microscope (SEM) at magnification of 300×. The image shown in FIG. 1B is a backscattered electron image of the cross section observed in the same manner at magnification of 1000×. As shown in FIG. 1A and FIG. 1B, the overlaid part 1 comprising high-melting-point metal comprises high-melting-point metal particles 2 scattered in a melt-solidified structure of the low-melting-point alloy, and the melt-solidified structure comprises the high-melting-point metal particles 2 and a binder phase 3 surrounding the high-melting-point metal particles 2.

The high-melting-point metal particles 2 are not particularly limited, provided that such high-melting-point metal particles comprise high-melting-point metal elements (a high-melting-point metal element) having a melting point of 2400° C. or higher that account for 90% by mass or more thereof. For example, the high-melting-point metal particles 2 have body-centered cubic (BCC) structures and comprise high-melting-point metal elements, such as W, Ta, Mo, and Nb, that account for 90% by mass or more thereof.

A binder phase 3 is, for example, a phase in which some of the high-melting-point metal elements comprised in the high-melting-point metal particles 2 is dissolved in a type of a low-melting-point alloy selected from among the Fe-based alloy, the Ni-based alloy, the Co-based alloy, the Ti-based alloy, the Cr-based alloy, and the high-entropy alloy described above. The binder phase 3 may be divided into two or three phases as shown in FIG. 1B depending on the combination of a low-melting-point alloy and the high-melting-point metal particles 2, production conditions, and the like. When the binder phase 3 is divided into two or more phases, the binder phase 3 is often divided into at least one of a solid-solution phase consisting of a face-centered-cubic (FCC) phase and a solid-solution phase consisting of a BCC phase and at least one intermetallic compound comprising high-melting-point metal elements (a high-melting-point metal element) comprised in the high-melting-point metal particles that accounts for 30% by mass or more thereof (hereafter, it may be abbreviated as an "intermetallic compound"). In such a case, the binder phase 3 is covered by an intermetallic compound having a high melting point. Thus, heat resistance is improved, and deformation or dissolution loss is less likely to occur. While the crystalline structure of the high-melting-point intermetallic compound varies depending on the combination of a low-melting-point alloy and the high-melting-point metal particles 2, for example, the crystalline structure may be the μ phase ($Fe_7W_6$) represented by the space group R-3m or the Laves C14 phase ($Fe_2W$) represented by the space group P63/mmc. Alternatively, the binder phase 3 may have a dendritic structure characteristic of the melt-solidified structure. The binder phase 3 may have, as the dendritic structure, either or both of the dendrite 4 having a solid-solution phase and the dendrite 5 consisting of an intermetallic compound. A dendritic structure is not observed in a sintered compact obtained by sintering, but it is observed in an overlaid part produced by additive manufacturing involving melt solidification. When a solid solution phase is an FCC phase having toughness superior to that of the BCC phase, the overlaid part has higher toughness, and cracking is less likely to occur at the time of molding.

[High-melting-point metal particles and intermetallic compound] It is preferable that the overlaid part comprising high-melting-point metal have the intermetallic compound and that the total area ratio of the high-melting-point metal particles and the intermetallic compound on the cross section of the overlaid part comprising high-melting-point metal be 20% or more. Both the high-melting-point metal particles and the intermetallic compound have high melting points, hardness, and chemical stability. If the total area ratio thereof is 20% or more, accordingly, the durability of the composite material is improved to a significant extent. In addition, high-melting-point metal particles do not substantially comprise other elements and thus have high thermal conductivity. The term "the total area ratio of the high-melting-point metal particles and the intermetallic compound on the cross section of the overlaid part comprising high-melting-point metal" refers to a percentage of an area thereof on the cross section of the overlaid part comprising high-melting-point metal (e.g., a cross section perpendicular to the travel direction of the overlaid part comprising high-melting-point metal). It is determined by, for example, cutting the overlaid part comprising high-melting-point metal to obtain a cross section, mirror-polishing the cross section, observing the cross section under a scanning electron microscope (SEM) to obtain a backscattered electron image, and subjecting the backscattered electron image to binary image processing.

The high-melting-point metal particles are not particularly limited, provided that the content of high-melting-point metal elements having a melting point of 2400° C. or higher is, for example, 90% by mass or more therein. For example, particles comprising at least one type of a high-melting-point metal element selected from among W, Ta, Mo, and Nb are preferable, particles comprising at least one type of such high-melting-point metal element that accounts for 90% by mass or more thereof are more preferable, and particles comprising W that accounts for 90% by mass or more thereof are particularly preferable for the following reason. That is, thermal conductivity can be improved because of high thermal conductivity of W. The high-melting-point metal particles may comprise V and/or Cr, in addition to the high-melting-point metal element.

[Method for producing composite material I] The method for producing a composite material according to an embodiment comprises a step of forming an overlaid part comprising high-melting-point metal in which high-melting-point metal particles are scattered by feeding starting powders comprising the high-melting-point metal powders having a melting point of 2400° C. or higher to the surface of the low-melting-point alloy member while applying a thermal energy to the surface of a low-melting-point alloy member having a melting point of 1600° C. or lower to melt the low-melting-point alloy member. In this step, the thermal energy is applied to at least a part on the surface of the low-melting-point alloy member to melt at least a part of the low-melting-point alloy member, starting powders comprising high-melting-point metal powders are simultaneously fed to the molten pool of it to melt the low-melting-point alloy and solidify the low-melting-point alloy. Thus, an overlaid part comprising high-melting-point metal in which high-melting-point metal particles comprising at least some of the high-melting-point metal powders without the at least some of the high-melting-point metal powder being dissolved in the low-melting-alloy are scattered is formed. In this case, it is critical to introduce high-melting-point metal powders having the melting point that is relatively different from that of the low-melting-point alloy member. A larger difference in the melting points enables the high-melting-point metal powders to remain in the form of high-melting-point metal particles in the overlaid part comprising high-melting-point metal without being dissolved in the low-melting-point alloy. The high-melting-point metal particles are excellent in hardness, heat resistance, and thermal conductivity. Thus, heat resistance and thermal conductivity of the composite material can be improved. In this step, only a small amount (e.g., approximately several % by mass) of a metal element (e.g., Fe) constituting the low-melting-point alloy may be dissolved in the high-melting-point metal particles at an insignificant level.

The low-melting-point alloy member used in the method for producing a composite material is as described in the "low-melting-point alloy member" section above. Accordingly, description thereof is omitted here. High-melting-point metal powders are not particularly limited, provided that such powders comprise high-melting-point metals having a melting point of 2400° C. or higher. High-melting-point metal powders may comprise one or more types of powders comprising high-melting-point metal. Examples of such high-melting-point metal powders include powders comprising at least one type of high-melting-point metal selected from among W, Ta, Mo, and Nb. Powders comprising at least one of such metals, such as powders consisting of W, powders consisting of Ta, powders consisting of Mo, and powders consisting of Nb are preferable, with powders consisting of W being particularly preferable. Such high-melting-point metal powders can also be supplemented with powders comprising other metals. Examples thereof include high-melting-point metal powders supplemented with powders comprising V and/or Cr.

A method for applying a thermal energy is not particularly limited, provided that it enables formation of an overlaid part. For example, a thermal energy may be applied by means of a plasma arc, laser beam, or electron beam. A method of powder overlay welding described below is preferable.

A method for producing a composite material is preferably a method for forming an overlaid part comprising high-melting-point metal while preheating the low-melting-point alloy member to 300° C. to 700° C. in the step of forming the overlaid part comprising high-melting-point metal. Such method is preferable because cracking of the composite material can be suppressed.

The method for producing a composite material according to a modified example may further comprise a step of forming a low-melting-point overlaid part after the step of forming the overlaid part comprising high-melting-point metal. In the step of forming a low-melting-point overlaid part, while a thermal energy is applied to the surface of the overlaid part comprising high-melting-point metal to melt the overlaid part comprising high-melting-point metal, starting powders comprising low-melting-point alloy powders having a melting point of 1600° C. or lower are fed to the surface of the overlaid part comprising high-melting-point metal. Thus, the low-melting-point overlaid part is formed. In the method for producing a composite material according to a further modified example, the overlaid parts comprising high-melting-point metal and the low-melting-point overlaid parts are preferably stacked alternately on top of each other on the surface of the low-melting-point alloy member. Such method is preferable because an increase in the melting point in a site of the member subjected to overlaying can be suppressed even if the number of stacking is increased.

A method for producing a composite material is preferably, for example, a method for forming a low-melting-point overlaid part while preheating the low-melting-point alloy member to 300° C. to 700° C. in the step of forming the low-melting-point overlaid part. Such method is preferable because cracking of the composite material can be suppressed.

[Method for producing composite material II] In the method for producing a composite material according to another embodiment, powders that further comprise low-melting-point alloy powders having a melting point of 1600° C. or lower may be fed as the starting powders, in addition to the high-melting-point metal powders, in the step of forming the overlaid part comprising high-melting-point metal. When high-melting-point metal powders are selectively overlaid, a melting point at a site of the member subjected to overlaying is elevated as the number of stacking of overlaid layers is increased. This makes molding difficult to be performed by overlaying, and the number of stacking performed by overlaying is limited to approximately 1 to 5. If powders further comprising low-melting-point alloy powders are overlaid in addition to the high-melting-point metal powders, an increase in a melting point at a site of the member subjected to overlaying can be suppressed even if the number of stacking is increased. Thus, 5 or more layers can be stacked by overlaying.

Low-melting-point alloy powders are not particularly limited, provided that such powders comprise a low-melting-point alloy having a melting point of 1600° C. or lower. Low-melting-point alloy powders may comprise one or more types of powders comprising a low-melting-point alloy. Such low-melting-point alloy powders preferably comprise, for example, one type of low-melting-point alloy selected from among an Fe-based alloy, an Ni-based alloy, a Co-based alloy, a Ti-based alloy, a Cr-based alloy, and a high-entropy alloy, and powders comprising the Fe-based alloy are particularly preferable. Such powders are preferable because the Fe-based alloy is small in cost, the Ni-based alloy is inferior to the Fe-based alloy in terms of resistance to Al dissolution loss, and the Co-based alloy and the Ti-based alloy are likely to generate brittle structures such as a regular BCC phase or an intermetallic compound when mixed with a mold material.

The method for producing a composite material is preferably a method for forming an overlaid part comprising high-melting-point metal while preheating the low-melting-point alloy member to 300° C. to 700° C. in the step of forming the overlaid part comprising high-melting-point metal. Such method is preferable because cracking of the composite material can be suppressed.

The method for producing a composite material according to a modified example may further comprise a step of forming a low-melting-point overlaid part after the step of forming the overlaid part comprising high-melting-point metal. In the step of forming a low-melting-point overlaid part, while a thermal energy is applied to the surface of the overlaid part comprising high-melting-point metal to melt the overlaid part comprising high-melting-point metal, starting powders comprising low-melting-point alloy powders having a melting point of 1600° C. or lower are fed to the surface of the overlaid part comprising high-melting-point metal. Thus, the low-melting-point overlaid part is formed. In the method for producing a composite material according to a further modified example, the overlaid parts comprising high-melting-point metal and the low-melting-point overlaid parts are preferably stacked alternately on top of each other on the surface of the low-melting-point alloy member. Such method is preferable because an increase in the melting point in a site of the member subjected to overlaying can be suppressed even if the number of stacking is increased.

A method for producing a composite material is preferably, for example, a method for forming a low-melting-point overlaid part while preheating the low-melting-point alloy member to 300° C. to 700° C. in the step of forming the low-melting-point overlaid part. Such method is preferable because cracking of the composite material can be suppressed.

[Method for producing composite material III] The method for producing a composite material according to another embodiment may further comprise, before the step of forming the overlaid part comprising high-melting-point metal, a step of forming a low-melting-point overlaid part by feeding starting powders comprising low-melting-point alloy powders having a melting point of 1600° C. or lower to the surface of the low-melting-point alloy member while applying a thermal energy to the surface of the low-melting-point alloy member to melt the low-melting-point alloy member. In the step of forming the low-melting-point overlaid part, the low-melting-point overlaid part may be formed as a part of the low-melting-point alloy member. In the step of forming the overlaid part comprising high-melting-point metal, the overlaid part comprising high-melting-point metal may be formed on the surface of the low-melting-point overlaid part of the low-melting-point alloy member by feeding the starting powders comprising the high-melting-point metal powders to the surface of the low-melting-point overlaid part of the low-melting-point alloy member while applying the thermal energy to the surface of the low-melting-point overlaid part of the low-melting-point alloy member to melt the low-melting-point alloy member.

The method for producing a composite material according to a modified example may further comprise a step of forming a low-melting-point overlaid part after the step of forming the overlaid part comprising high-melting-point metal. In the step of forming a low-melting-point overlaid part, while a thermal energy is applied to the surface of the overlaid part comprising high-melting-point metal to melt the overlaid part comprising high-melting-point metal, the starting powders comprising the low-melting-point alloy powders are fed to the surface of the overlaid part comprising high-melting-point metal. Thus, the low-melting-point overlaid part is formed. In the method for producing a composite material according to a further modified example, the overlaid parts comprising high-melting-point metal and the low-melting-point overlaid parts are preferably stacked alternately on top of each other on the surface of the low-melting-point alloy member. Such method is preferable because an increase in the melting point in a site of the member subjected to overlaying can be suppressed even if the number of stacking is increased, and 5 or more layers can be stacked.

The method for producing a composite material is preferably, for example, a method for forming a low-melting-point overlaid part while preheating the low-melting-point alloy member to 300° C. to 700° C. in the step of forming the low-melting-point overlaid part. Such method is preferable because cracking of the composite material can be suppressed.

[High-melting-point metal powders] High-melting-point metal powders are not particularly limited, provided that such powders can be fed for powder overlaying. The average particle diameter may be in a range of 1 μm to 200 um. Such average particle diameter is preferably in a range of 10 μm to 180 μm and more preferably in a range of 20 μm to 150 um because such particle diameters facilitate powder feeding. High-melting-point metal powders are not limited to those selectively comprising powders comprising high-melting-point metal, and high-melting-point metal powders may be granulated powders prepared with the addition of a small amount of metals having low melting points, such as Ni, Co, or Fe, as binders to the powders comprising high-melting-point metal. Further, high-melting-point metal powders preferably have the enhanced sphericity by, for example, thermal plasma droplet refining (PDR). Such powders are preferable because enhanced powder fluidity can further stabilize powder feeding.

A method for producing high-melting-point metal powders is not particularly limited. When producing high-melting-point metal powders, such as powders consisting of W, compounds such as oxides of starting materials may be reduced to produce powders.

[Low-melting-point alloy powders] A method for producing low-melting-point alloy powders is not particularly limited. For example, low-melting-point alloy powders can be produced by an atomization method. In the atomization method, molten metal is scattered as droplets with the aid of a motion energy of a high-pressure spray medium and solidified to form powders. The atomization method is classified as a water atomization method, a gas atomization method, or a jet atomization method depending on an atomizing medium used. Any of such atomization methods can be adopted for the method for producing low-melting-point alloy powders.

The water atomization method involves the use of water as an atomizing medium. In the water atomization method, a molten metal is allowed to flow down from the bottom of a tundish, high-pressure water is atomized to the molten metal stream as an atomizing medium, and the molten metal is pulverized with the aid of a motion energy of water. In the water atomization method, a cooling rate at the time of solidification is faster than that in other atomization methods. However, powders obtained by the water atomization method have irregular shapes.

The gas atomization method involves the use of, for example, inert gas such as nitrogen or argon or high-pressure gas such as air as an atomizing medium. Powders obtained by the gas atomization method easily become spherical. Because a cooling rate by gas is smaller than a cooling rate by water, molten particles of droplets become spherical because of the surface tension before the molten particles are solidified.

The jet atomization method involves the use of, for example, a combustion flame of kerosene as an atomizing medium. In the jet atomization method, a high-temperature flame jet is sprayed onto a molten metal at a speed higher than the sonic speed, and the molten metal is accelerated and pulverized for a relatively long period of time to form powders. Powders obtained by the jet atomization method easily become spherical, and a further refined particle distribution can be achieved.

In the electrode induction melting gas atomization (EIGA) method, an ingot is prepared, the ingot as an electrode material is melted with the use of an induction coil to directly atomize gas to the ingot. By preparing an ingot in a furnace with a high stirring power and adopting the EIGA method, powders of homogeneous compositions can be obtained.

[Method of alloy powder overlaying] Methods of overlaying of powders such as high-melting-point metal powders and low-melting-point alloy powders are not particularly limited, provided that an overlaid part, such as an overlaid part comprising high-melting-point metal or a low-melting-point overlaid part, can be formed on the surface of a member subjected to overlaying. Examples of methods that can be adopted include the method of plasma powder overlay welding and the method of laser powder overlay welding. The method of plasma powder overlay welding and the method of laser powder overlay welding can be types of additive manufacturing methods.

The method of plasma powder overlay welding involves the use of a plasma as a heat source. In the method of plasma powder overlay welding, welding is performed in an inert argon atmosphere. This enables formation of an overlaid part having a smooth surface and a small number of pores in its inside.

The method of laser powder overlay welding involves the use of a laser as a heat energy source. In the method of laser powder overlay welding, a heat input zone can be narrowed down. When a member subjected to overlaying is thin, accordingly, overlaying can be performed. In the method of laser powder overlay welding, in addition, a temperature-increased area of the member subjected to overlaying is narrow. This increases a temperature gradient of the member, temperature of the member subjected to overlaying is rapidly decreased after the laser beam passes therethrough, and the member is quenched. Thus, the method of laser powder overlay welding is advantageous for refinement of a dendritic structure because of a high solidification speed at the time of melting and solidification.

As the method of laser powder overlay welding, laser metal deposition (LMD) can be adopted. LMD comprises applying a laser beam to the surface of the member subjected to overlaying to melt the surface and simultaneously feeding the starting powders to the surface of the member to form an overlaid part.

In a method of powder overlaying, an overlaid part may be formed while preheating the member subjected to overlaying (e.g., a member of a mold) to 300° C. to 700° C. in accordance with a material or configuration of the member subjected to overlaying. By performing preheating, deformation or cracking of an overlaid part caused by overlaying can be suppressed. A method of preheating is not particularly limited. For example, preheating can be performed by means of high-frequency induction heating, a gas burner, an infrared electric heater, a heating furnace, or application of an electron beam or a laser.

As starting powders for the overlaid part, alloy powders produced by the method described above or a method other than the method described above can be used.

The overlaid part, such as the overlaid part comprising high-melting-point metal or the low-melting-point overlaid part in which the content, the type, and other properties of high-melting-point metal particles are varied in accordance with, for example, the likelihood of damage or deformation occurring in regions of a structure, such as a mold, can be formed in various regions on the surface of the member subjected to overlaying. As described above, an adequate overlaid part may be formed in an adequate region on the surface of the member subjected to overlaying in accordance with the likelihood of damage or deformation occurring in various regions of a mold, so that a structure, such as a high-performance mold, that is excellent in anti-dissolution loss can be obtained.

[Application] A composite material can be used for any application without particular limitation, provided that a composite material can be used for a structure for an intended use. A mold such as a casting mold is preferable as the application (the structure), a casting mold used for casting of an aluminum alloy, such as a low-pressure casting, gravity casting, or die casting mold, is more preferable, and a casting mold used for die casting of an aluminum alloy is particularly preferable. Such casting molds are preferable because remarkable effects, such as improved dissolution loss resistance, can be achieved. A casting mold for an aluminum alloy is not particularly limited. Examples thereof include a low-pressure casting mold used for molding aluminum wheels and a casting mold used for molding aluminum cylinder heads for engines. The composite material can be extensively used for structures other than a casting mold that are required to be resistant to high temperatures. For example, the composite material can be used for a bearing that may generate a frictional heat at a high-speed revolution.

An application of the composite material may be a new structure, such as a casting mold, produced from a material or a repaired structure prepared by forming an overlaid part comprising high-melting-point metal in a site on the surface of a structure such as a casting mold where a damage or deformation has occurred (at least a part on the surface of the low-melting-point alloy member).

The method for producing a composite material may be adopted for a method for producing a new structure such as a casting mold or a method for producing a repaired structure prepared by forming an overlaid part comprising high-melting-point metal in a site on the surface of a structure such as a casting mold where a damage or deformation has occurred.

EXAMPLES

Hereafter, the composite material, the method for producing the composite material, and the mold according to the present invention are described in greater detail with reference to the examples.

[Example 1] At the outset, a plate material of the Fe-based alloy shown in Table 1 was prepared.

TABLE 1

| Fe | Ni | Co | Mo | Ti | Al | C | Mn | Si | P | S |
|---|---|---|---|---|---|---|---|---|---|---|
| Bal. | 18.51 | 9.11 | 4.91 | 0.91 | 0.1 | 0.02 | 0.01 | 0.03 | 0.003 | <0.001 |

Subsequently, pure tungsten powders consisting of W (high-melting-point metal powders) were overlaid on a part of the surface of the prepared plate material of the Fe-based alloy (i.e., a low-melting-point alloy member) via laser metal deposition (LMD) to perform additive manufacturing. In this case, a composite material comprising a layer of pure tungsten powders overlaid thereon (Sample No. 1) and a composite material comprising 2 layers of pure tungsten powders overlaid thereon (Sample No. 2) were produced.

Specifically, the composite material (Sample No. 1) was produced by performing a step of powder overlaying comprising applying a laser beam to melt the surface of the plate material of an Fe-based alloy and simultaneously feeding pure tungsten powders (starting powders) to the surface of the plate material of an Fe-based alloy once, in order to form a layer of an overlaid part comprising high-melting-point metal. The composite material (Sample No. 2) was produced by performing a step of powder overlaying comprising applying a laser beam to melt the surface of the plate material of an Fe-based alloy and simultaneously feeding pure tungsten powders to the surface of the plate material of an Fe-based alloy two times, in order to form two layers of overlaid parts comprising high-melting-point metal. Particle diameters of pure tungsten powders used herein were 53 μm or smaller, and Lasertec 65-3D (DMG MORI CO., LTD.) was used as an apparatus for additive manufacturing. Conditions for powder overlaying were as described below.

Conditions for Powder Overlaying

Laser scanning speed: 500 mm/min
Starting powder feed rate: 14 g/min
Laser beam output: 2.0 kW

Figure 2A:
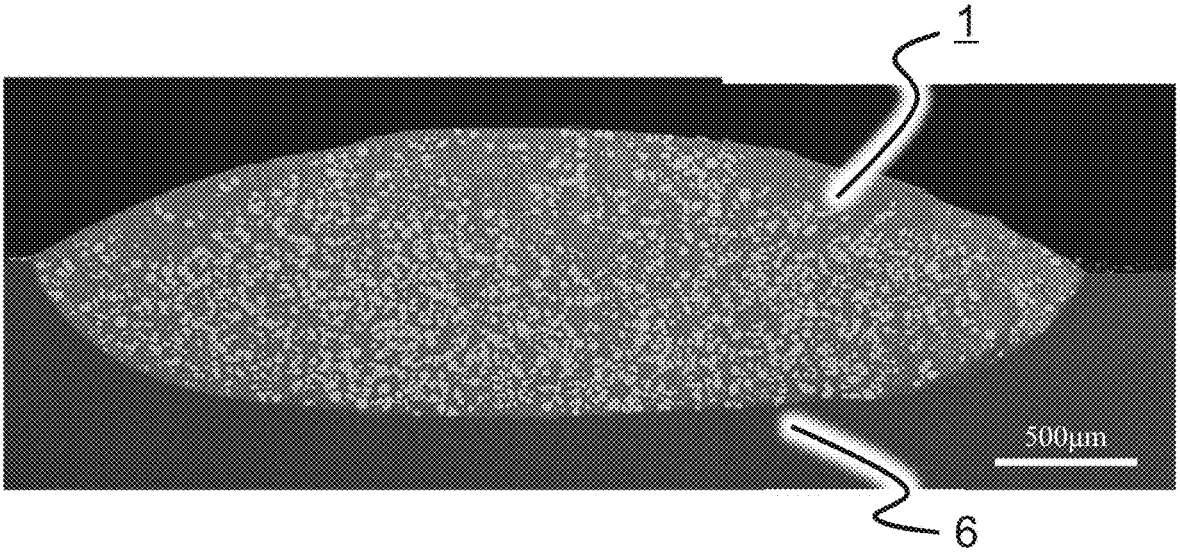
FIG. 2A shows a backscattered electron image of the overlaid part comprising high-melting-point metal of Sample No. 1 of Example 1 observed at 50× magnification.
Figure 2B:
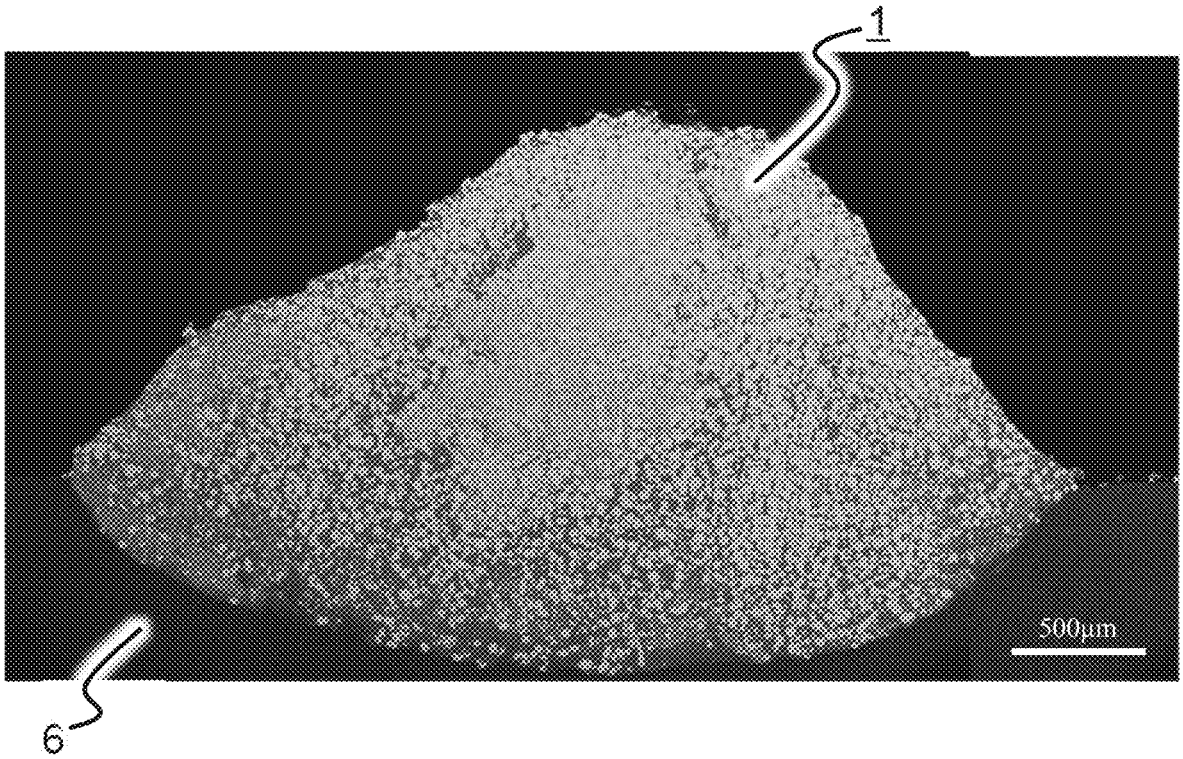
FIG. 2B shows a backscattered electron image of the overlaid part comprising high-melting-point metal of Sample No. 2 of Example 1 observed at 50× magnification.

[SEM observation and component analysis] The cross section perpendicular to the travel direction of the bead (the overlaid part comprising high-melting-point metal) was cut from the composite material of Sample No. 1 and that of Sample No. 2, the cut cross sections were mirror-polished, and the backscattered electron images (BEIs) of the polished cross sections were observed under a scanning electron microscope (SEM). FIG. 2A and FIG. 2B each show a backscattered electron image of the overlaid part comprising high-melting-point metal of Sample No. 1 and that of Sample No. 2 observed at 50× magnification, respectively. The amounts of reflected electrons generated vary depending on elements constituting a sample. As the atomic number increases, the number of electrons generated increases. In the backscattered electron image, accordingly, a region comprising a large number of elements with large atomic numbers looks white, and a region comprising a large number of elements with small atomic numbers looks black. When focusing on the bead of tungsten powder overlaying (the overlaid part 1 comprising high-melting-point metal) on a plate material of an Fe-based alloy (the low-melting-point alloy member 6), scattered particles that look white are observed in both FIG. 2A and FIG. 2B. Such scattered particles are tungsten particles remaining undissolved.

Figure 3A:
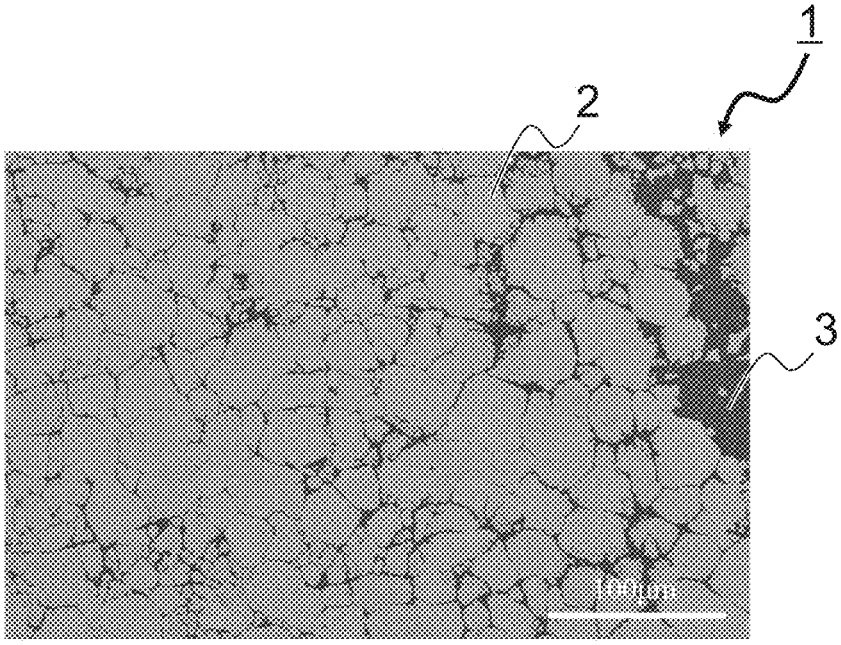
FIG. 3A shows a backscattered electron image of the overlaid part comprising high-melting-point metal of Sample No. 2 of Example 1 observed at 300× magnification.
Figure 3B:
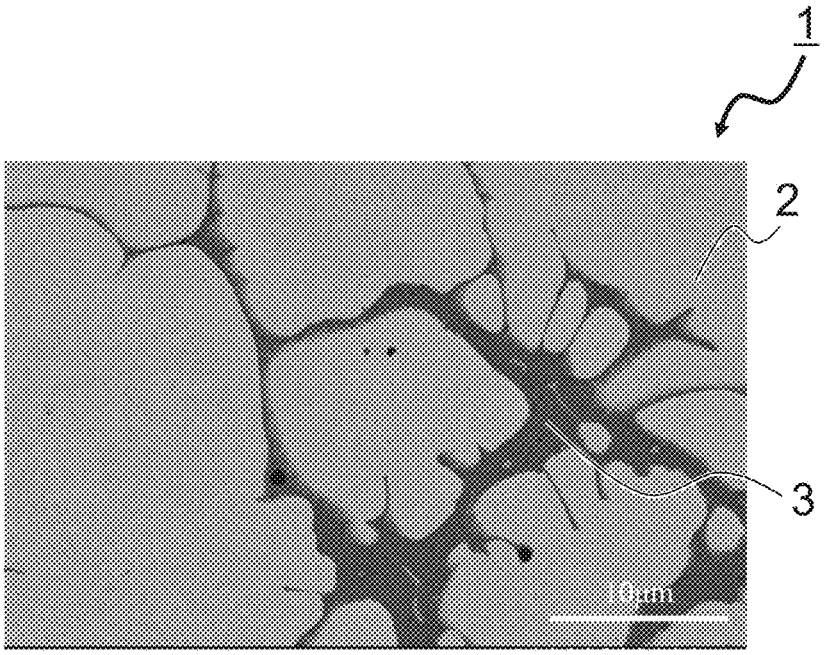
FIG. 3B shows a backscattered electron image of the overlaid part comprising high-melting-point metal of Sample No. 2 of Example 1 observed at 3000× magnification.

The composite material of Sample No. 1 was observed by SEM at a higher magnification. FIG. 1A and FIG. 1B each show a backscattered electron image of the overlaid part comprising high-melting-point metal of Sample No. 1 observed by SEM at 300× magnification and that observed at 1000× magnification, respectively. The composite material of Sample No. 2 was observed by SEM at higher magnifications (300× and 3000×). FIG. 3A and FIG. 3B each show a backscattered electron image of the overlaid part comprising high-melting-point metal of Sample No. 2 observed at 300× magnification and that observed at 3000× magnification, respectively. As shown in FIG. 1A, FIG. 1B, FIG. 3A, and FIG. 3B, the overlaid part 1 comprising high-melting-point metal is composed of high-melting-point metal particles 2 and a binder phase 3 surrounding the high-melting-point metal particles 2. When focusing on FIG. 1B, deposition of a high-melting-point intermetallic compound is observed in the binder phase 3. Concerning Sample No. 1, a dendritic high-melting-point intermetallic compound 5 and a nanometer-scale deposition of a banded high-melting-point intermetallic compound 8 were observed.

Table 2 shows the results of component analysis of the entire overlaid part 1 comprising high-melting-point metal, the high-melting-point metal particles 2, and the binder phase 3 of Sample No. 1 and Sample No. 2 shown in FIG. 1A and FIG. 3A performed by energy dispersive X-ray spectroscopy (EDX). In Table 2, values indicating the component ratios are % by mass.

TABLE 2

| | | Component ratio (% by mass) | | |
|---|---|---|---|---|
| Sample | Site | W | Fe | Ni |
| Sample No. 1 | Entire overlaid part comprising high-melting-point metal 1 | 66.1 | 27.2 | 6.7 |
| | High-melting-point metal particles 2 | 100 | — | — |
| | Binder phase 3 | 43.7 | 43.9 | 12.5 |
| Sample No. 2 | Entire overlaid part comprising high-melting-point metal 1 | 91.1 | 8.9 | — |
| | High-melting-point metal particles 2 | 100 | — | — |
| | Binder phase 3 | 34.2 | 51.6 | 14.2 |

When focusing on a component ratio of the entire overlaid part comprising high-melting-point metal shown in Table 2, all the samples are found to comprise tungsten W that accounts for 50% by mass or more thereof. In Sample No. 2 comprising 2 layers stacked thereon, in particular, the component ratio of W is very high, which is 90% by mass or more. When focusing on a component ratio of high-melting-point metal particles, the component ratio of W is found to be 100% by mass in all the samples. This indicates that high-melting-point metal particles are pure tungsten powders used for powder overlaying that remain undissolved in a low-melting-point alloy. When focusing on a component ratio of binder phases, W is detected in all binder phases. This indicates that some of the introduced pure tungsten powders is dissolved in a low-melting-point alloy in the binder phase.

Table 3 shows the results of measurement of the total area ratio of the high-melting-point metal particles and the intermetallic compound in the binder phase on the cross section of the overlaid part comprising high-melting-point metal of Sample No. 1 and of Sample No. 2. The total area ratio of the high-melting-point metal particles and the intermetallic compound on the cross section of the overlaid part comprising high-melting-point metal was determined by subjecting the backscattered electron images of the samples observed at 100× magnification to binary image processing. Table 3 demonstrates that the total area ratio of the high-melting-point metal particles and the intermetallic compound on the cross section of the overlaid part comprising high-melting-point metal is 20% or higher in both Sample No. 1 and Sample No. 2. In Sample No. 1 and Sample No. 2, the intermetallic compound was finely deposited, so that it could not be observed at 100× magnification, and it was thus impossible to accurately measure the area ratio thereof. Therefore, the actual total area ratio of the high-melting-point metal particles and the intermetallic compound on the cross section of the overlaid part comprising high-melting-point metal is deduced to be higher than the value shown in Table 3.

TABLE 3

| Sample | Area ratio (%) |
|---|---|
| Sample No. 1 | 29.2 |
| Sample No. 2 | 82.0 |

[STEM observation] In order to perform crystalline structure analysis and component (element) mapping of the fine structure of the overlaid part comprising high-melting-point metal of the composite material of Sample No. 1, in addition, high-magnification observation was performed under a scanning transmission electron microscope (STEM).

Specifically, a plane of the composite material of Sample No. 1 was first mirror-polished, and a test strip with a thickness of approximately 100 nm was cut from the polished plane by the microsampling method using the focused ion beam (FIB). In the microsampling method, FB-2100 (Hitachi High-Tech Corporation) was used. Subsequently, the test strip was subjected to high-magnification observation by STEM. Conditions for STEM observation were as described below.

Conditions for STEM Observation

Figure 4A:
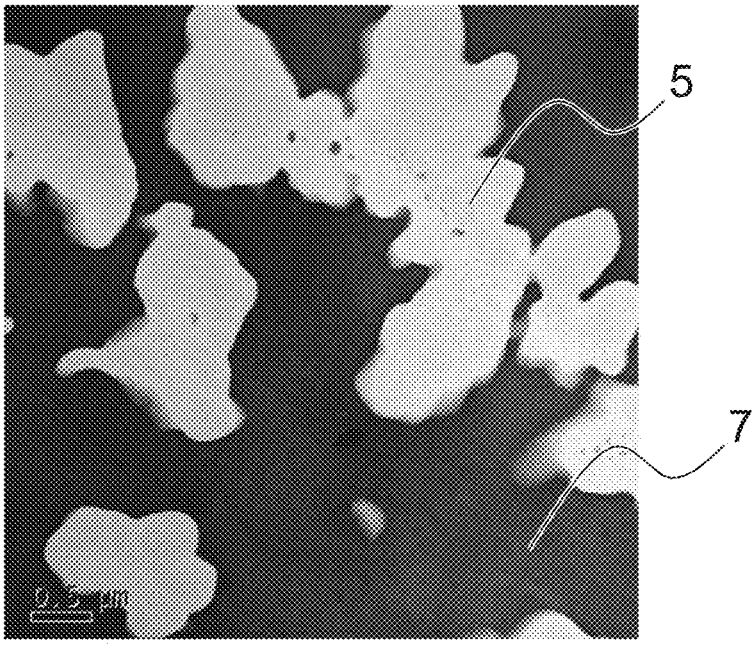
FIG. 4A shows a DF-STEM image of a region surrounding a dendritic high-melting-point intermetallic compound of the overlaid part comprising high-melting-point metal of Sample No. 1 of Example 1.
Figure 4B:
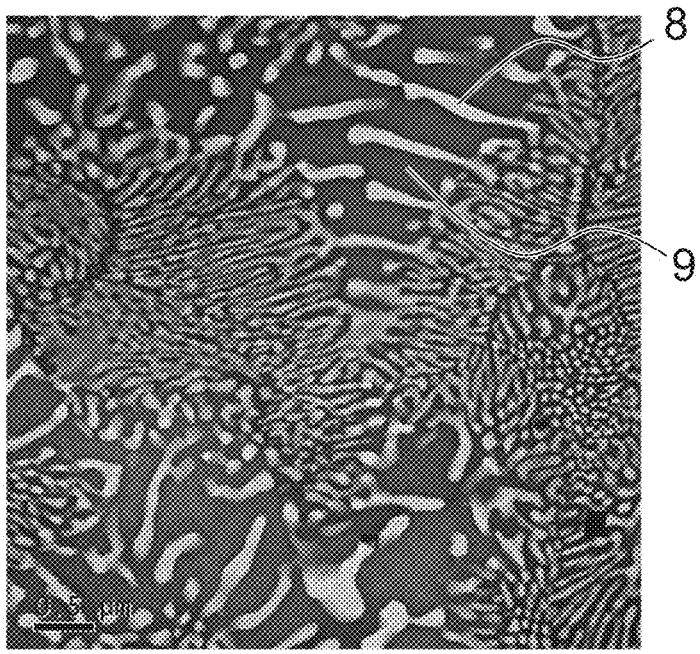
FIG. 4B shows a DF-STEM image of a region surrounding a banded high-melting-point intermetallic compound of the overlaid part comprising high-melting-point metal of Sample No. 1 of Example 1.
Figure 5A:
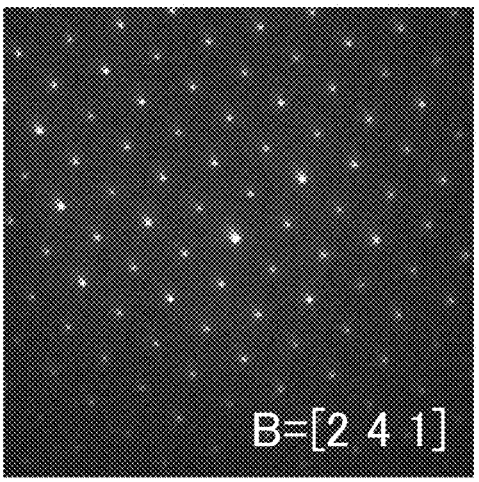
FIG. 5A shows an electron diffraction pattern of a dendritic high-melting-point intermetallic compound.
Figure 5B:
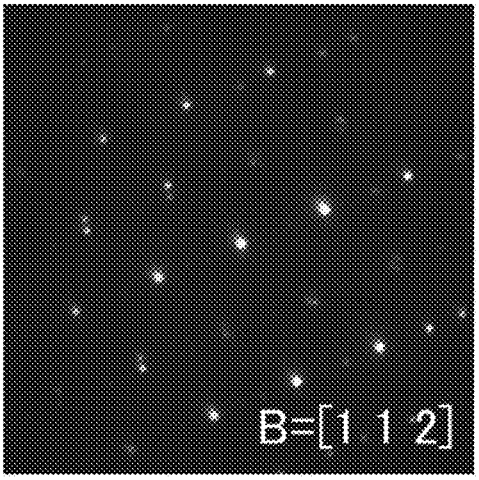
FIG. 5B shows an electron diffraction pattern of the solid-solution phase in a region surrounding a dendritic high-melting-point intermetallic compound.
Figure 5C:
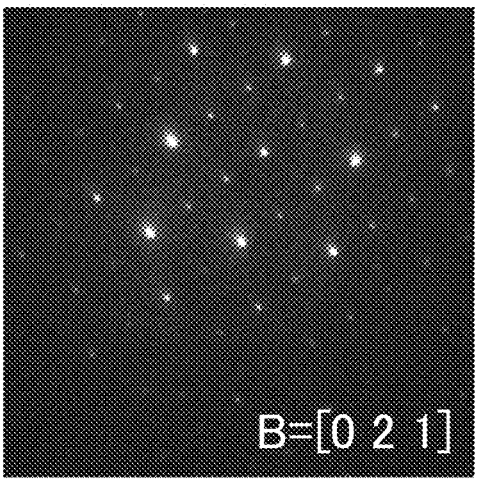
FIG. 5C shows an electron diffraction pattern of a banded high-melting-point intermetallic compound.
Figure 5D:
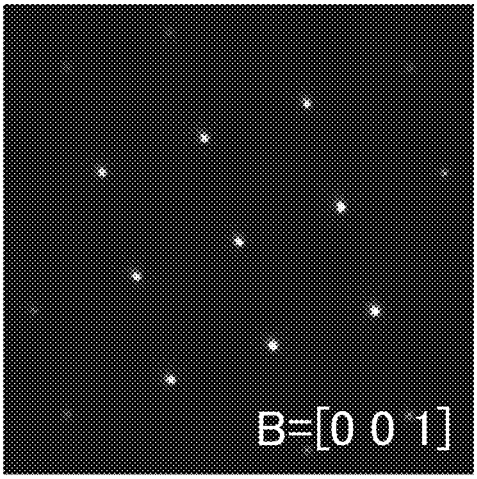
FIG. 5D shows an electron diffraction pattern of the solid-solution phase in a region surrounding a banded high-melting-point intermetallic compound.

Sample thickness: 100 nm
Apparatus type: JEM-ARM200F (JEOL Ltd.)
Acceleration voltage: 200 kV FIG. 4A shows a dark field image surrounding the dendritic high-melting-point intermetallic compound 5 obtained by STEM observation of the overlaid part comprising high-melting-point metal of Sample No. 1 (DF-STEM), and FIG. 4B shows a DF-STEM image surrounding the banded high-melting-point intermetallic compound 8 obtained by STEM observation of the overlaid part comprising high-melting-point metal of Sample No. 1. Table 4 shows the results of measurement of the component ratio of the dendritic high-melting-point intermetallic compound 5, the solid-solution phase 7 surrounding the dendritic high-melting-point intermetallic compound, the banded high-melting-point intermetallic compound 8, and the solid-solution phase 9 surrounding the banded high-melting-point intermetallic compound by EDX. In Table 4, values indicating the component ratios are % by mass. Table 4 demonstrates that W is intensified in the dendritic high-melting-point intermetallic compound 5 and the banded high-melting-point intermetallic compound 8.

TABLE 4

| Position of | Component ratio (% by mass) | | | | | | |
|---|---|---|---|---|---|---|---|
| analysis | Fe | N | W | Co | Mo | Ti | Al |
| Dendritic high-melting-point intermetallic compound 5 | 32.9 | 5.6 | 53.2 | 5.1 | 2.6 | 0.3 | 0.5 |
| Solid-solution phase 7 surrounding dendritic high-melting-point intermetallic compound | 53.6 | 15.9 | 19.8 | 7.6 | 2.4 | 0.6 | 0.3 |
| Banded high-melting-point intermetallic compound 8 | 34.4 | 7.0 | 47.8 | 5.5 | 4.3 | 0.8 | 0.4 |
| Solid-solution phase 9 surrounding | 42.6 | 10.0 | 37.3 | 6.2 | 3.3 | 0.6 | 0.3 |

TABLE 4-continued

| Position of analysis | Component ratio (% by mass) | | | | | | |
|---|---|---|---|---|---|---|---|
| | Fe | N | W | Co | Mo | Ti | Al |
| banded high-melting-point intermetallic compound | | | | | | | |

FIG. 5A, FIG. 5B, FIG. 5C, and FIG. 5D each show an electron diffraction pattern of the dendritic high-melting-point intermetallic compound 5, the solid-solution phase 7 surrounding the dendritic high-melting-point intermetallic compound, the banded high-melting-point intermetallic compound 8, and the solid-solution phase 9 surrounding the banded high-melting-point intermetallic compound obtained by STEM observation. FIG. 5 shows the incident direction of an electron beam in its lower right part. As a result of pattern analysis, the dendritic high-melting-point intermetallic compound 5 was found to be the μ phase ($Fe_7W_6$) represented by the space group: R-3m, the banded high-melting-point intermetallic compound 8 was found to be the Laves C14 phase ($Fe_2W$) represented by the space group: P63/mmc, and the solid-solution phases 7 and 9 were found to be FCC phases. Since the FCC phase has high toughness and excellent anti-cracking properties, toughness of the entire overlaid part comprising high-melting-point metal is improved as a result of formation of the solid-solution phase of the FCC phase in the binder phase.

Figure 6:
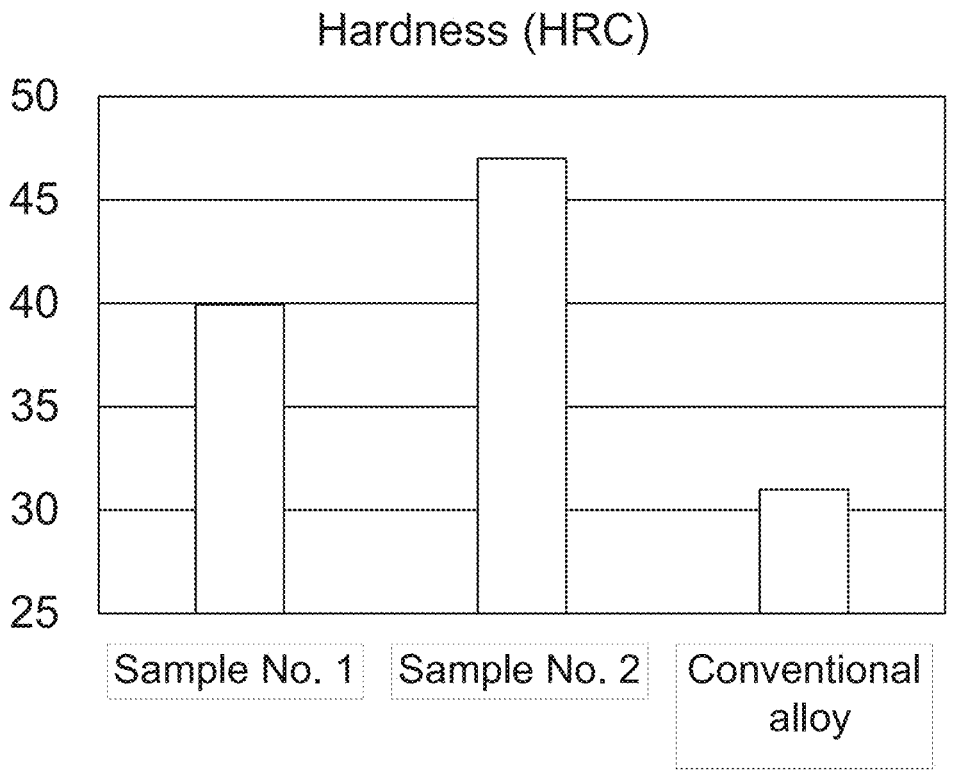
FIG. 6 shows a chart demonstrating the Rockwell hardness values of Sample No. 1 and Sample No. 2 of Example 1 and the Rockwell hardness value of a conventional alloy.

[Evaluation of Rockwell hardness] The Vickers hardness (HV) of the overlaid part comprising high-melting-point metal of the composite material of Sample No. 1 and that of Sample No. 2 were measured. In this case, measurement was performed using a Vickers hardness tester at room temperature with a load of 1,000 gf for a retention time of 15 seconds. Measurement was performed 10 times, and the average of the 8 measured values excluding the maximal value and the minimal value was designated as the Vickers hardness value. In order to compare with conventional alloys, the Vickers hardness value was converted to the Rockwell hardness value (HRC). For conversion, a reference was made to Table 2 of ASTM E140 (ASTM: the American Society for Testing and Materials). The results are shown in FIG. 6. FIG. 6 shows a chart demonstrating the Rockwell hardness values of Sample No. 1 and Sample No. 2 and the Rockwell hardness value of a conventional alloy. The conventional alloy is DENSIMET 185 (Plansee SE, Austria). DENSIMET is a registered trademark of Plansee. As shown in FIG. 6, the Rockwell hardness values of Sample No. 1 and Sample No. 2 were 40 HRC or higher, and such hardness was sufficient as a material for repairing the casting mold for aluminum alloys.

[Example 2] Subsequently, additive manufacturing was performed by powder overlaying by laser metal deposition (LMD) on the plate material of the Fe-based alloy shown in Table 1 (the low-melting-point alloy member) by the method of simultaneously delivering the Fe-based alloy powders having the composition as shown in Table 5 and the pure tungsten powders to the molten pool. In the present example, 15 layers of the powders were stacked to produce a powder-overlaid composite material (Sample No. 3). Specifically, while a laser beam was applied to melt the surface of the plate material of the Fe-based alloy, starting powders comprising powders comprising an Fe-based alloy and pure tungsten powders were fed to the surface of the plate material of the Fe-based alloy to overlay powders. This procedure was repeated 15 times to stack 15 layers of the overlaid part comprising high-melting-point metal. Thus, a composite material (Sample No. 3) was prepared. As the powders comprising the Fe-based alloy having the composition as shown in Table 5 below, powders with particles with particle sizes of 53 μm to 106 μm (D50: 81.5 μm) were used, and pure tungsten powders as used in Example 1 were used herein.

TABLE 5

| Fe | Ni | Co | Mo | Ti | Al | C | Si | N | O |
|---|---|---|---|---|---|---|---|---|---|
| Bal. | 17.8 | 0.49 | 2.01 | 1.97 | 0.1 | 0.0064 | 0.3 | 0.001 | 0.0161 |

As the apparatus for additive manufacturing, the apparatus as used in Example 1 was used. Conditions for powder overlaying were as described below.

Conditions for Powder Overlaying

Laser scanning speed: 500 mm/min
Starting powder feed rate: Fe-based alloy powder: 7 g/min; pure tungsten powders: 7 g/min
Laser beam output: 1.75 kW
Stacking pass: 30 mm×5
Bead pitch: 1.5 mm
Preheating temperature: 500° C.

Figure 7A:
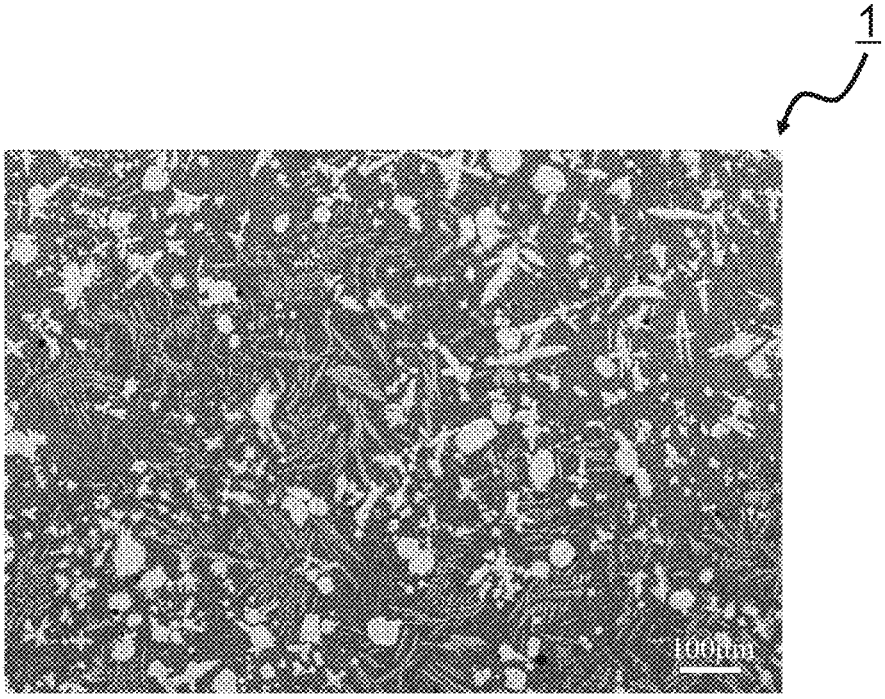
FIG. 7A shows a backscattered electron image of the overlaid part comprising high-melting-point metal of Sample No. 3 of Example 2 observed at 100× magnification.
Figure 7B:
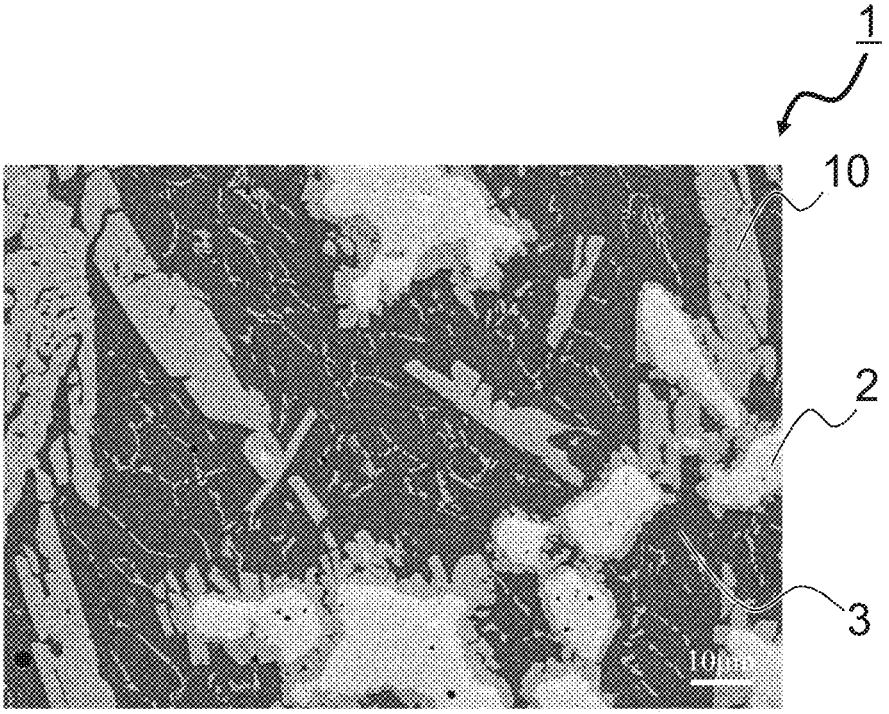
FIG. 7B shows a backscattered electron image of the overlaid part comprising high-melting-point metal of Sample No. 3 of Example 2 observed at 1000× magnification.

[SEM observation and component analysis] The cross section perpendicular to the travel direction of the bead (the overlaid part comprising high-melting-point metal) was cut from the composite material of Sample No. 3, the cut cross section was mirror-polished, and the backscattered electron image (BEI) of the polished cross section was observed under a scanning electron microscope (SEM). FIG. 7A and FIG. 7B each show a backscattered electron image of the composite material of Sample No. 3 observed at 100× magnification and at 1000× magnification, respectively.

Table 6 shows the results of component analysis of the entire overlaid part 1 comprising high-melting-point metal, the high-melting-point metal particles 2 (white), the intermetallic compound 10 (gray), and the binder phase 3 (black) of Sample No. 3 shown in FIG. 7B performed by energy dispersive X-ray spectroscopy (EDX).

TABLE 6

| Sample | Site | Component ratio (% by mass) | | |
|---|---|---|---|---|
| | | W | Fe | Ni |
| Sample No. 3 | Entire overlaid part comprising high-melting-point metal 1 | 54.3 | 36.0 | 9.7 |
| | High-melting-point metal particles 2 | 96.3 | 3.7 | — |
| | Intermetallic compound 10 | 71.4 | 24.8 | 3.8 |
| | Binder phase 3 | 28.9 | 56.0 | 15.1 |

The total area ratio of the high-melting-point metal particles and the intermetallic compound in the binder phase on the cross section of the overlaid part comprising high-melting-point metal of the composite material of Sample No. 3 was also measured using the backscattered electron image shown in FIG. 7B in the same manner as with the case of Sample No. 1 and Sample No. 2. As a result, the total area ratio was found to be 27.3%.

[Aluminum dissolution loss test] Dissolution loss was tested by soaking the composite material of Sample No. 3 in molten aluminum. In the dissolution loss test, a dissolution loss test strip with a dimension and a configuration of φ4.8 mm×20 mm was cut from the composite material of Sample No. 3, the test strip was mounted on a holder, and the position of the furnace body was adjusted to soak the test strip by a length of 10 mm in molten aluminum. Thus, the test was initiated. The test was performed at a rate of 5 m/min for a soaking period of 30 minutes. As molten aluminum, Al—Si—Mg-based JIS AC4CH was used, and the molten metal temperature was set at 993 K. For comparison, a 50-μm nitride layer and a 150-μm nitride layer were each formed by radical nitriding on the surface of JIS SKD61 to prepare 2 types of SKD61-nitrided materials. The comparative materials were then subjected to the dissolution loss test as with the case of the composite material of Sample No. 3.

The results are shown in Table 7 below. The dissolution loss rate is determined in accordance with the equation below. Dissolution loss rate (% by mass)=(mass before dissolution loss test-mass after dissolution loss test)/mass before dissolution loss test×100

TABLE 7

| Sample | Mass (g) Before dissolution loss test | After dissolution loss test | Dissolution Loss rate (% by mass) | Remarks |
|---|---|---|---|---|
| SKD61-nitrided material (nitride layer: 50 μm) | 2.7276 | 2.6402 | 3.20 | Comp. Ex. |
| SKD61-nitrided material (nitride layer: 150 μm) | 2.7318 | 2.6703 | 2.25 | Comp. Ex. |
| Sample No. 3 | 4.1924 | 4.1862 | 0.15 | Ex. 2 |

As shown in Table 7, the composite material of Sample No. 3 according to Example 2 shows a smaller dissolution loss rate than that of the nitride material according to the comparative example, and it has excellent dissolution loss resistance.

[Example 3] At the outset, 2 plate materials of JIS SKD61 shown in Table 8 (low-melting-point alloy member; 20 mm×100 mm×t10 mm) were prepared.

TABLE 8

| Fe | Cr | Mo | V | C | Mn | Si | P | N | O |
|---|---|---|---|---|---|---|---|---|---|
| Bal. | 5.1 | 1.25 | 0.86 | 0.36 | 0.42 | 0.89 | 0.003 | 0.0032 | 0.0123 |

Subsequently, one of the two prepared SKD61 plate materials was not subjected to any further processing, and the other SKD61 plate material (a low-melting-point alloy member) was subjected to overlaying of a layer of Fe-based alloy powders (low-melting-point alloy powders) by laser metal deposition (LMD) in a part on the surface thereof. Specifically, a step of powder overlaying comprising applying a laser beam to melt the surface of the SKD61 plate material and simultaneously feeding the Fe-based alloy powders used in Example 2 (shown in Table 5) to the surface of the SKD61 plate material was performed once, in order to form a layer of the low-melting-point overlaid part. As an apparatus for additive manufacturing, Lasertec 65-3D (DMG MORI CO., LTD.) was used. Conditions for powder overlaying were as described below.

Conditions for Powder Overlaying of Fe-Based Alloy Powder

Laser scanning speed: 800 mm/min
Starting powder feed rate: 8 g/min
Laser beam output: 1.5 kW On each of the SKD61 plate material without any further processing as described above and the other SKD61 plate material comprising a layer of the low-melting-point overlaid part formed on a part of the surface thereof as described above, a layer of pure tungsten powders consisting of W (high-melting-point metal powders) was overlaid on a part of the surface. On the SKD61 plate material without any further processing, specifically, a step of powder overlaying comprising applying a laser beam to melt the surface of the SKD61 plate material and simultaneously feeding pure tungsten powders to the surface of the SKD61 plate material was performed once, in order to form a layer of the overlaid part comprising high-melting-point metal. On the plate material comprising a layer of the low-melting-point overlaid part formed on a part of the surface of the SKD61 plate material, a step of powder overlaying comprising applying a laser beam to melt the surface of the low-melting-point overlaid part and simultaneously feeding pure tungsten powders (starting powders) to the surface of the low-melting-point overlaid part was performed once, in order to form a layer of the overlaid part comprising high-melting-point metal on the low-melting point overlaid part. The pure tungsten powders as used in Example 1 were used herein. As an apparatus for additive manufacturing, Lasertec 65-3D (DMG MORI CO., LTD.) was used. Conditions for powder overlaying were as described below.

Conditions for Powder Overlaying of Pure Tungsten Powder

Laser scanning speed: 500 mm/min
Starting powder feed rate: 14 g/min
Laser beam output: 2.0 kW As described above, the composite material of Sample No. 4 comprising a layer of pure tungsten powders (high-melting-point metal powders) directly overlaid on the SKD61 plate material and the composite material of Sample No. 5 comprising the SKD61 plate material, a layer of Fe-based alloy powders (low-melting-point alloy powders) overlaid thereon, and a layer of pure tungsten powders further overlaid thereon were obtained.

[Evaluation of Rockwell hardness and observation of appearance] The Vickers hardness (HV) of the overlaid parts comprising high-melting-point metal of the composite materials of Sample No. 4 and Sample No. 5 were measured in the same manner as in Example 1, and the Rockwell hardness (HRC) thereof was evaluated. The results demonstrate that the Rockwell hardness of Sample No. 4 was 54.2 HRC and the Rockwell hardness of Sample No. 5 was 47.7 HRC.

Further, the appearances of the overlaid parts comprising high-melting-point metal of the composite materials of Sample No. 4 and Sample No. 5 were observed. The results demonstrate that cracking may occur in a part of the overlaid part comprising high-melting-point metal of Sample No. 4. In contrast, no cracking was detected in the overlaid part comprising high-melting-point metal of Sample No. 5.

Direct overlaying of pure tungsten powders (high-melting-point metal powders) on the SKD61 plate material may increase the Rockwell hardness and cause cracking in the overlaid part. When the Fe-based alloy powders (low-melting-point alloy powders) were overlaid on the SKD61 plate material and pure tungsten powders were further overlaid thereon, in contrast, the Rockwell hardness of the overlaid part was not excessively increased, and cracking was less likely to occur. If tungsten powders (high-melting-point metal powders) are overlaid on the SKD61 plate material while preheating the SKD61 plate material to 300° C. to 700° C., cracking can be suppressed.

[Evaluation of structure] The crystalline structures of the overlaid parts comprising high-melting-point metal of the composite materials of Sample No. 4 and Sample No. 5 were analyzed by the electron backscatter diffraction (EBSD) method. The results demonstrate that the solid-solution phase of the overlaid part comprising high-melting-point metal of Sample No. 4 is the BCC phase and that of Sample No. 5 is the FCC phase. By overlaying a layer of Fe-based alloy powders on the composite material of Sample No. 5, the solid-solution phase of the overlaid part comprising high-melting-point metal would become the FCC phase with excellent toughness, toughness of the entire overlaid part would be improved, and cracking would be less likely to occur at the time of overlaying.

Depending on types of the low-melting-point alloy members, as described above, another low-melting-point alloy (e.g., Fe-based alloy as shown in Table 5) may be overlaid on the low-melting-point alloy member, and pure tungsten may further be overlaid thereon. Thus, overlaying can be performed under an extensive range of production conditions. When pure tungsten is to be overlaid directly on the low-melting-point alloy member as with the case of Sample No. 4, pure tungsten is preferably overlaid while preventing cracking due to thermal stress at the time of formation by a method such as preheating at high temperature.

The embodiments of the present invention are described above with reference to the figures and the like. It should be noted that the present invention is not limited to the embodiments described above. Any embodiments having substantially the identical constitution and similar effects with the technique disclosed in the claims of the present invention are within the technical scope of the present invention, and the present invention includes various modified examples. For example, the embodiments are intended to illustrate the present invention, and the present invention is not limited to embodiments comprising all the constitutions described herein. Also, a part of a constitution according to an embodiment may be substituted with a constitution according to another embodiment, and a constitution according to another embodiment may be added to a constitution according to an embodiment. In addition, a part of a constitution according to an embodiment may be supplemented with, deleted, or substituted with other constitutions.

REFERENCE SIGNS LIST

1: Overlaid part comprising high-melting-point metal
2: High-melting-point metal particles
3: Binder phase
4: Dendrite having solid-solution phase
5: Dendritic high-melting-point intermetallic compound (dendrite consisting of intermetallic compound)
6: Low-melting-point alloy member
7: Solid-solution phase surrounding dendritic high-melting-point intermetallic compound
8: Banded high-melting-point intermetallic compound
9: Solid-solution phase surrounding banded high-melting-point intermetallic compound
10: High-melting-point intermetallic compound All publications, patents, and patent applications cited herein are incorporated herein by reference in their entirety.

The invention claimed is:

1. A composite material comprising an overlaid part comprising a high-melting-point metal in at least a part on the surface of a low-melting-point alloy member having a melting point of 1600° C. or lower, wherein the overlaid part comprising the high-melting-point metal comprises high-melting-point metal particles comprising high-melting-point metal elements having a melting point of 2400° C. or higher scattered therein and comprises the high-melting-point metal elements in a range of 50% by mass to 95% by mass, and wherein the overlaid part comprising high-melting-point metal comprises a binder phase surrounding the high-melting-point metal particles in which the high-melting-point metal elements are dissolved in an alloy having a melting point of 1600° C. or lower comprised in the low-melting-point alloy member and the binder phase comprises an FCC phase.

2. The composite material according to claim 1, wherein the high-melting-point metal particles comprise the high-melting-point metal elements that account for 90% by mass or more of the high-melting-point metal particles.

3. The composite material according to claim 1, wherein the overlaid part comprising the high-melting-point metal has an intermetallic compound comprising the high-melting-point metal elements that account for 30% by mass or more of the intermetallic compound, and the total area ratio of the high-melting-point metal particles and the intermetallic compound on a cross section of the overlaid part comprising the high-melting-point metal is 20% or more.

4. The composite material according to claim 1, wherein a depth of overlaying from the surface of the overlaid part comprising the high-melting-point metal is 500 μm or more.

5. The composite material according to claim 1, wherein the overlaid part comprising the high-melting-point metal has a Rockwell hardness of 40 HRC or higher.

6. The composite material according to claim 1, wherein the low-melting-point alloy member comprises one type of an alloy having a melting point of 1600° C. or lower selected from among a Fe-based alloy, a Ni-based alloy, a Co-based alloy, a Ti-based alloy, a Cr-based alloy, or a high-entropy alloy, and wherein the high-melting-point metal particles comprise at least one type of high-melting-point metal element selected from among W, Ta, Mo, or Nb.

7. A mold using the composite material according to claim 1.

* * * * *